US006198031B1

(12) United States Patent
Jones

(10) Patent No.: US 6,198,031 B1
(45) Date of Patent: Mar. 6, 2001

(54) MUSICAL INSTRUMENT CABLE LOCK

(76) Inventor: William L. Jones, 1660 Mill St., Eugene, OR (US) 97401

( * ) Notice: Subject to any disclaimer, the term of this patent is extended or adjusted under 35 U.S.C. 154(b) by 0 days.

(21) Appl. No.: 09/575,617

(22) Filed: May 22, 2000

Related U.S. Application Data

(60) Provisional application No. 60/137,485, filed on Jun. 4, 1999.

(51) Int. Cl.[7] ..... G10D 3/00
(52) U.S. Cl. ..... 84/329; 224/910
(58) Field of Search ..... 84/327, 329; 224/268, 224/910

(56) References Cited

U.S. PATENT DOCUMENTS

| | | | |
|---|---|---|---|
| D. 337,345 | | 7/1993 | Gracie . |
| D. 360,427 | | 7/1995 | Gracie . |
| 1,292,545 | | 1/1919 | Wanamaker . |
| 3,237,502 | | 3/1966 | Moseley . |
| 3,371,570 | | 3/1968 | Lester . |
| 3,659,319 | | 5/1972 | Erickson . |
| 3,665,490 | | 5/1972 | Oskar . |
| 3,951,504 | * | 4/1976 | Clark . |
| 4,357,063 | * | 11/1982 | Gray . |
| 4,715,259 | * | 12/1987 | Wittman ..... 84/327 |
| 5,127,300 | | 7/1992 | Silverman . |
| 5,145,399 | | 9/1992 | Davenport . |
| 5,582,524 | | 12/1996 | Sanner et al. . |
| 5,616,874 | | 4/1997 | Kraus et al. . |
| 5,728,959 | | 3/1998 | O'Rorke . |

* cited by examiner

*Primary Examiner*—Jeffrey Donels
(74) *Attorney, Agent, or Firm*—Richard C. Litman

(57) ABSTRACT

A cord or cable lock for preventing a cord or cable from being accidentally pulled out of a socket of a musical instrument, due to tugs on the cable or cord, is disclosed. The cable lock is in the form of a strip which is curled or curved at one end to give a J-shaped profile to the cable lock. Near the end distal from the curved portion, the cable lock has a hole which allows the cable lock to be mounted to a musical instrument using a screw. The curved portion of the cable lock surrounds the cable and frictionally grips the cable to keep tugs on the cable from being transmitted to a plug at the end of the cable. Thus the plug is prevented from being pulled out of the socket in the musical instrument.

19 Claims, 9 Drawing Sheets

MUSICAL INSTRUMENT CABLE LOCK

CROSS-REFERENCE TO RELATED APPLICATION

This application claims the benefit of U.S. Provisional Patent Application Ser. No. 60/137,485, filed Jun. 4, 1999.

BACKGROUND OF THE INVENTION

1. Field of the Invention

The present invention relates to a lock or clip for keeping the amplifier cable of a musical instrument from being accidentally pulled out.

2. Description of Related Art

Many musical instruments today have provision for connection to an amplifier via an electrical cable or cord. For example, an electric guitar generally has to be connected to an amplifier which amplifies the signal produced by the guitar into a signal that car be used to drive loud speakers. The guitar is connected to the amplifier by an amplifier cord which has a plug at its end. The plug is plugged into a special socket which is built into the guitar or the pickup in the case of an electrified acoustic guitar.

It is common practice for a player or musician playing the guitar to walk around on the stage upon which the musician is performing. If the musician is walking about on the stage and he or she steps on the amplifier cable or if the amplifier cable gets caught on some other object such as other musical instruments, steps, microphone stand, etc., then the amplifier plug can be accidentally pulled out of the guitar's socket causing an interruption in the music being heard by the audience. Also a performer moving about on the stage can trip on the amplifier cable attached to another performer's instrument, such as a keyboard, guitar, etc., causing that instrument's amplifier cable to be unplugged from that instrument. Needless to say, this would be a very embarrassing situation for the performer.

For this reason, cable or cord locks that prevent an amplifier plug from being accidentally pulled out of a musical instrument, in particular a guitar, have been proposed in the art. However, cable locks thus far proposed are not entirely satisfactory because they are limited in application to those guitars having nonrecessed sockets, and these cable locks are difficult and time consuming to install on the instrument and/or to remove from the instrument. Therefore, the need persists in the art for a more practical and easy to apply musical instrument cable lock.

Examples of previously proposed musical instrument cable locks can be found among the references cited below. The other references cited below relate in general to accessories for use with guitars.

U.S. Pat. No. 5,728,959, issued to John D. O'Rorke on Mar. 17, 1998, shows a guitar tuner holder which includes a base capable of being clamped to a microphone stand. The base has a hook-and-loop fastener portion which engages a complementary hook-and-loop fastener portion which is adhesively secured to the guitar tuner.

U.S. Pat. No. 5,616,874, issued to Peter C. Kraus, et al. on Apr. 1, 1997, shows a training aid for teaching the proper stance while playing a guitar in the seated position. The training aid includes a belt and a plurality of cords that extend from the belt to the guitar.

U.S. Pat. No. 5,582,524, issued to Dennis Sanner, et al. on Dec. 10, 1996, shows a cord lock for preventing two cords that are plugged together from being pulled apart. One cord terminates in a plug and the other cord terminates in a socket. The cord lock has a base with an eyelet at each end. A loop from, each cord is placed through a respective eyelet and placed around a respective hook member projecting from the base in order to prevent accidental tugs on the cords from pulling apart the plug and socket.

U.S. Pat. No. 5,145,399, issued to Kenneth S. Davenport on Sep. 8, 1992, shows a cord lock for keeping the amplifier cord of an electric guitar from being accidentally pulled out. The cord lock of Davenport includes a support collar that fits under the lock nut securing the guitar amplifier socket in place. A leg having a plurality of holes is pivotally attached to the support collar. A clamp, which clamps to the amplifier cord behind the amplifier plug, is secured to the leg in order to keep the amplifier plug in place. The cord lock of Davenport only works with guitar amplifier sockets which are not recessed in the body of the guitar. Further, the cord lock of Davenport requires, at least, the disassembly of the guitar amplifier socket for its installation.

U.S. Pat. No. 5,127,300, issued to Martin D. Silverman on Jul. 7, 1992, shows a guitar pick holder that can be attached to the head stock of the guitar and can hold a plurality of picks. The guitar pick holder of Silverman includes a pair of resilient, opposing, parallel strips that grip each pick in between one another.

U.S. Pat. No. 3,665,490, issued to John Raymond Oskar on May 23, 1972, shows a microphone holder that clamps to a guitar.

U.S. Pat. No. 3,659,319, issued to Lloyd A. Erickson on May 2, 1972, shows an adhesive wire routing clip. The Erickson device includes a base portion having a pair of hook-like projections.

U.S. Pat. No. 3,371,570, issued to Luther D. Lester on Mar. 5, 1968, shows a guitar support having a pair of belt clips that can support the guitar on the guitar player's belt, thus eliminating the need for a guitar sling.

U.S. Pat. No. 3,237,502, issued to Semie A. Moseley on Mar. 1, 1966, shows a stringed instrument with a tuning system which works either by adjusting the heights of the string guides above the sounding board or by moving the string guides parallel to the strings.

U.S. Pat. No. 1,292,545, issued to Charles B. Wanamaker on Jan. 28, 1919, shows a specially designed hook having a roller bearing for firmly securing a drum hoop to a drum.

U.S. Design Patent Number Des. 360,427, issued to John D. Gracie on Jul. 18, 1995, shows a guitar holder for a musical instrument stand.

U.S. Design Patent Number Des. 337,345, issued to John D. Gracie on Jul. 13, 1993, shows a stand for supporting a guitar.

None of the above inventions and patents, taken either singly or in combination, is seen to describe the instant invention as claimed.

SUMMARY OF THE INVENTION

The present invention is directed to a musical instrument cable lock for preventing the amplifier cable or cord of a musical instrument, such as an electric guitar, from being accidentally pulled out of the instrument due to tugs on the amplifier cable. The musical instrument cable lock is in the form of a strip which is curled or curved at one end to give a J-shaped profile to the cable lock. Near the end distal from the curved portion, the musical instrument cable lock has a hole which allows the cable lock to be mounted to a musical instrument using a screw. The frictionally grips the amplifier cable to keep tugs on the amplifier cable from being transmitted to the amplifier plug which is plugged into the musical instrument's amplifier socket.

Accordingly, it is a principal object of the invention to provide a cable lock that prevents a plug from being accidentally pulled out of a socket due to tugs on the cable attached to the socket. Also allows assistant to easily change instruments during a performance.

It is another object of the invention to provide a cable lock for use with a guitar which can be mounted to the guitar without requiring any modification to the guitar.

It is a further object of the invention to provide a cable lock that is usable with all types of musical instruments including guitars, keyboards, or other instruments regardless of whether the musical instrument has a recessed or nonrecessed socket.

Still another object of the invention is to provide a cable lock that is simple to manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
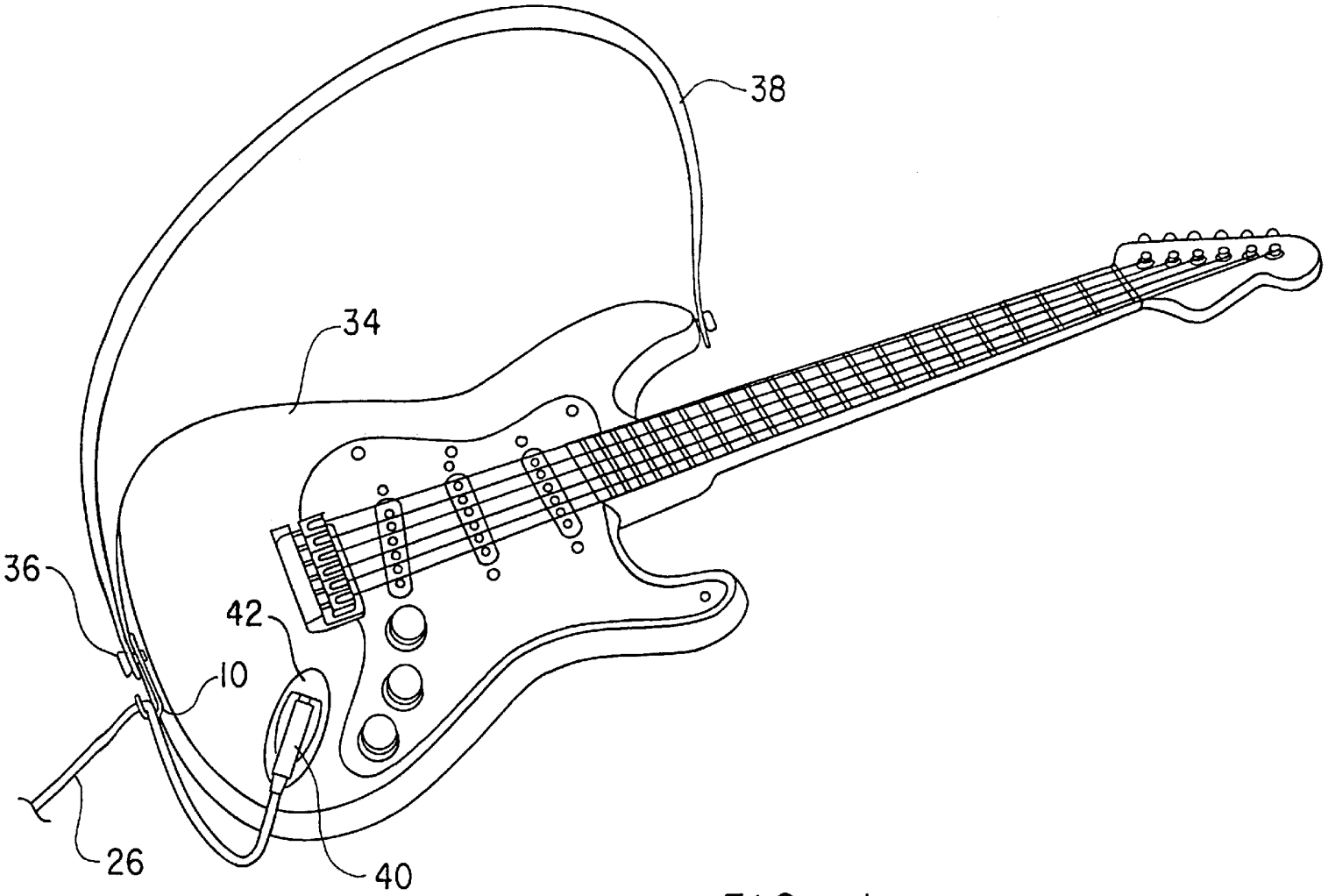
FIG. 1 is an environmental view of a musical instrument cable lock according to the present invention.
Figure 3:
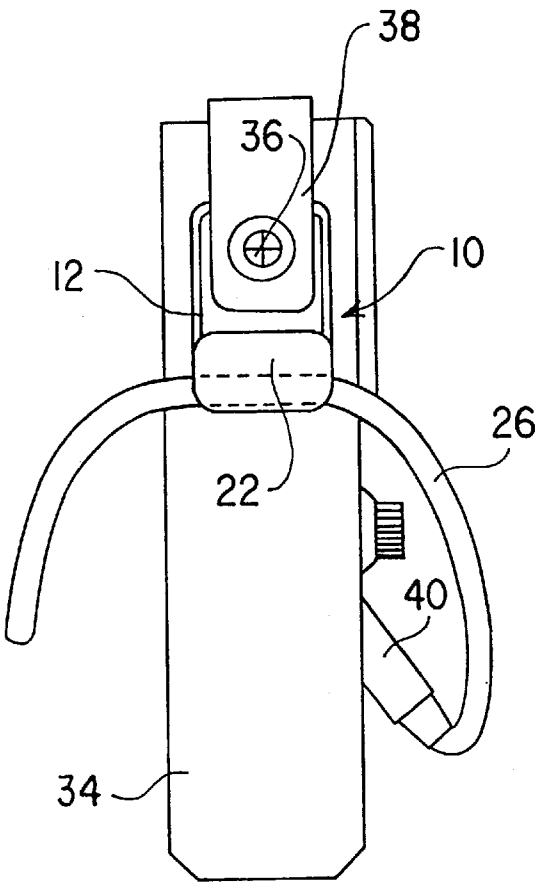
FIG. 3 is an environmental detail view showing a front view of the musical instrument cable lock according to the present invention attached to a guitar.
Figure 2:
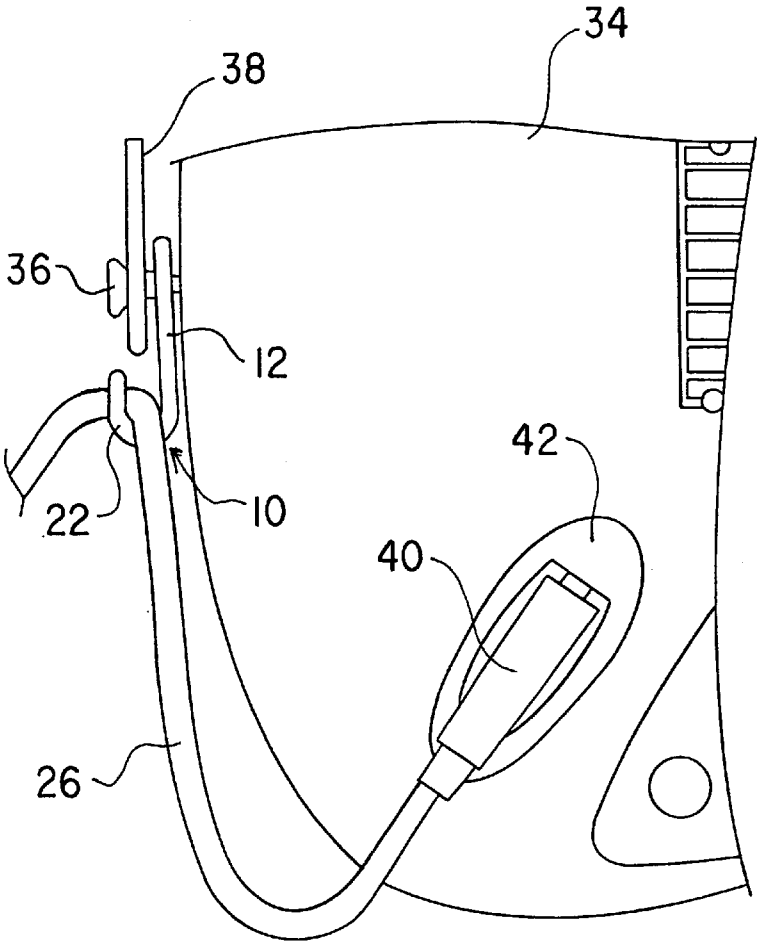
FIG. 2 is an environmental detail view showing a side view of the musical instrument cable lock according to the present invention attached to a guitar.

The present invention is a musical instrument cable or cord lock 10 designed to keep the amplifier cable or cord 26 of a musical instrument from being accidentally unplugged. For illustrative purposes the cable lock 10 is discussed herein in the context of its application to a guitar. However, it should be noted that the cable lock 10 is generally applicable wherever a cable needs to be prevented from becoming unplugged due to accidental tugs on the cable. The cable lock 10 has a base portion 12. In the illustrated embodiment, the base portion 12 is substantially rectangular in plan view. The base portion 12 has a top side 14, a first lateral side 16, a second lateral side 18, and a bottom boundary 20. The base portion 12 is substantially rectangular in the sense that one or more corners of the base portion 12 may be rounded to avoid sharp corners as a safety measure. In the illustrated example, the corners at either end of the top side 14 of the base portion 12 are rounded. Further, the base portion 12 is in the form of a plate having an essentially uniform thickness.

Extending from the bottom boundary 20 is a curved-back portion 22. The curved-back portion 22 is formed by a continuation of the base portion 12 which extends from the bottom boundary 20 and curves back toward the top edge 14 so as to form a channel having a substantially U-shaped cross section attached to the bottom boundary 20. Thus, the base portion 12 and the curved-back portion 22 are constructed of one continuous piece. The curved-back portion 22 gives the cable lock 10 a substantially J-shaped appearance when viewed along a line having a direction parallel to the dimension of the base portion 12 which extends perpendicularly between the lateral sides 16 and 18 such that the lateral sides 16 and 18 appear superimposed to the viewer.

Figure 4:
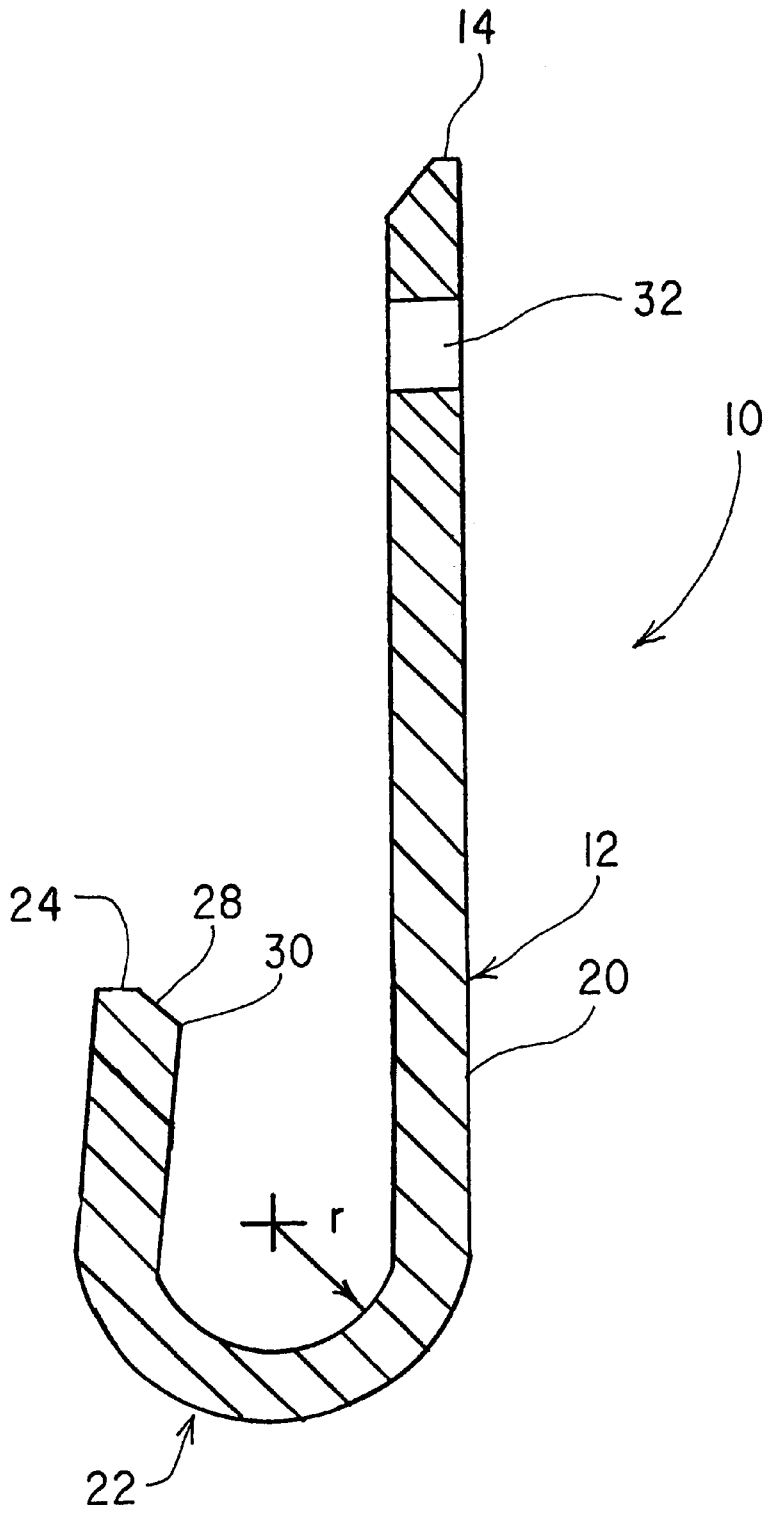
FIG. 4 is a longitudinal section view of the musical instrument cable lock according to the present invention.
Figure 5:
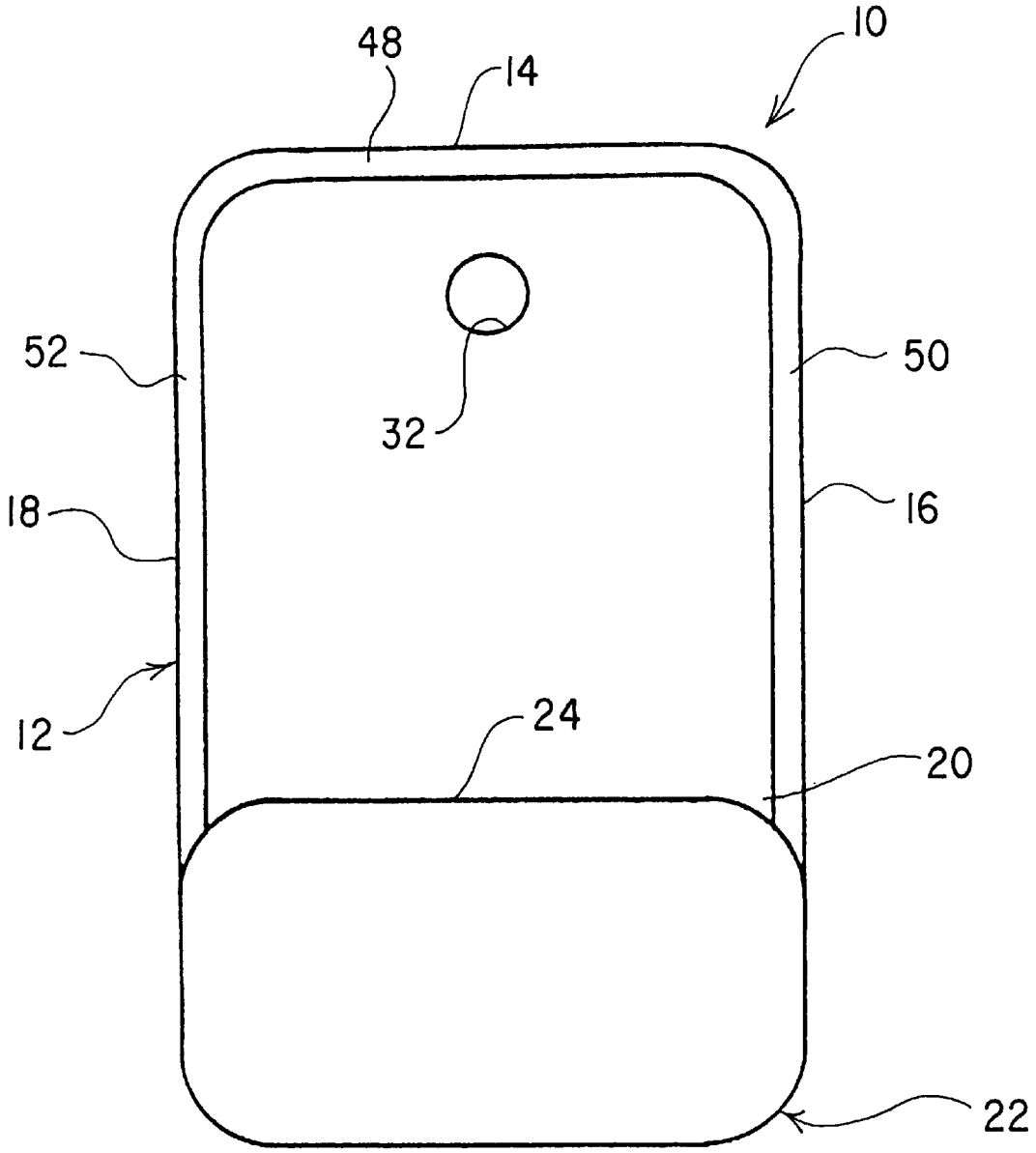
FIG. 5 is a front view of the musical instrument cable lock according to the present invention.

Again viewing the cable lock 10 from a direction such that the lateral sides 16 and 18 appear superimposed to the viewer (as shown in FIG. 4), the curved-back portion 22 curves back toward the base portion 12 with an inner radius of curvature r, as the curved-back portion 22 extends from the bottom boundary 20 and terminates at a distal terminal side 24. The distal terminal side 24 faces in generally the same direction as the top side 14. The inner radius of curvature r is approximately the same as or slightly smaller than the outside radius of the guitar amplifier cable 26. For example, the inner radius of curvature r can be about one eighth of an inch in order to accommodate a one quarter inch diameter cable.

Figure 6:
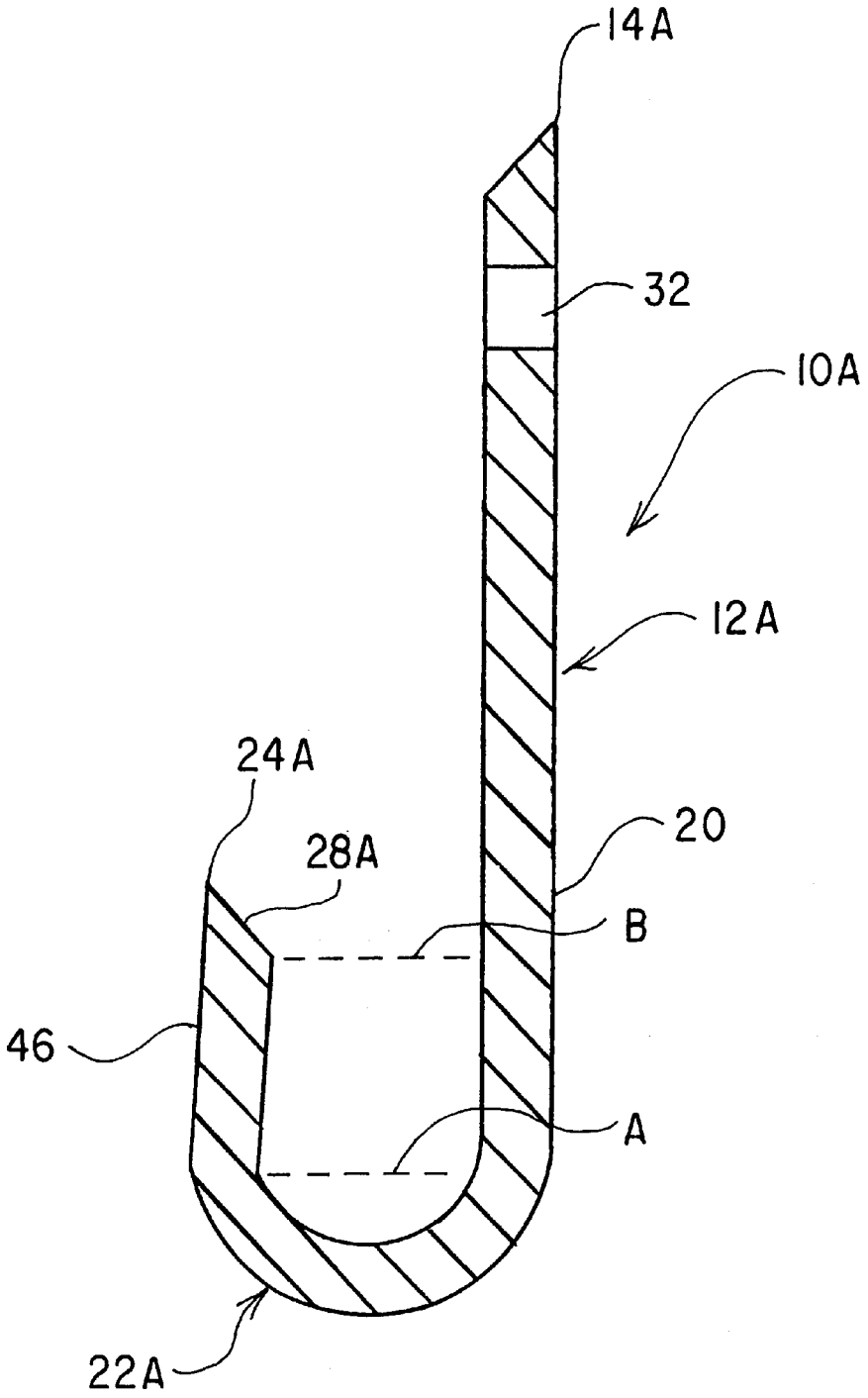
FIG. 6 is a longitudinal section view of a second embodiment of the musical instrument cable lock according to the present invention.

Adjacent and contiguous with the distal terminal side 24 is a beveled surface 28 formed on the side of the curved-back portion 22 which is closer to the base portion 12. The beveled surface 28 extends from the distal terminal side 24 approximately toward the center of curvature of the curved-back portion 22. The beveled surface 28 terminates at a ridge 30. The upwardly extending part of the curved-back portion 22 which defines the leg of the U-shaped channel opposite to the base portion 12 is not exactly parallel to the base portion 12, but is indented or slightly bent back towards the base portion 12 so that the width of the base of the channel, depicted by the dashed line A in FIG. 6, is slightly greater than the width of the channel at its mouth, depicted by the dashed line B in FIG. 6. Assuming that the width of the channel at its base at A is one quarter of an inch in order to accommodate a one quarter inch diameter cable, than the width of the channel at its mouth at B may be between about one sixteenth and one thirty-second of an inch, preferably one-thirty-second of an inch. Thus, the cable 26 is retained in the cable lock 10 not only by friction, but by the slight overhang of the ridge 30 above the channel.

The beveling operation which forms the beveled surface 28 can be applied to the entire periphery of the cable lock 10, thus forming the beveled surfaces 48, 50, and 52. The beveled surfaces 48, 50, and 52 further eliminate sharp edges that can damage the cable 26.

A hole 32 is formed near the top side 14 and passes through the thickness of the base portion 12. The hole 32 allows the cable lock 10 to be mounted to a guitar 34. In the illustrated example, the screw 36 which is used to attach the guitar sling 38 to the guitar is employed for mounting the cable lock 10 to the guitar 34. The shaft of the screw 36 is passed through the hole 32 before the screw 36 is engaged to the already existing threaded hole for attaching the guitar sling. Thus, the cable lock 10 can be mounted to the guitar 34 without requiring any modification to the guitar. Alternatively, a hole can be drilled in the guitar body and tapped. A screw can then be passed through the hole 32 and then engaged to the specially drilled hole to mount the cable lock 10 to the guitar. This alternative method can also be applied to other musical instruments which do not have a suitable preexisting threaded hole.

The cable lock 10 is fabricated from a semi-rigid material. The term semi-rigid as used herein refers to any metal, plastic, or composite materials which substantially maintain their shape under the stresses that would be applied to the cable lock 10 during normal use, however, the semi-rigid materials are sufficiently flexible such that the U-shaped channel that is the curved-back portion 22 can be spread wider by allowing the beveled surface 28 to move away from the base portion 12 as the amplifier cable is pressed in toward the bottom of the curved-back portion 22. Examples of suitable semi-rigid materials would be the hard plastics, spring steel, composite materials, and aluminum.

In use, the cable lock 10 is mounted to the guitar in the manner which has already been described. A portion of the amplifier cable 26, located some distance away from the amplifier plug 40, is then wedged between the beveled surface 28 and the base portion 12. The semi-rigid construction of the cable lock 10 permits sufficient flexibility to the portion of the cable lock 10 proximate the distal terminal side 24 to allow the ridge 30 to move away from the bottom boundary 20 of the base portion 12 as the cable 26 is pressed in toward the bottom of the curved-back portion 22. The amplifier cable is then pressed in toward the bottom of the curved-back portion 22 until the amplifier cable snaps into the curved-back portion 22 and into contact with the bottom of the curved-back portion 22. The cable 26 may also have sufficient flexibility to become compressed enough to squeeze past the ridge 30 into the channel. The amplifier cable 26 is now frictionally gripped by the cable lock 10. The frictional grip of the cable lock 10 on the amplifier cable 26 will prevent the portion of the amplifier cable extending between the plug 40 and the cable lock 10 from being pulled through the cable lock 10 due to tugs on the portion of the amplifier cable 26 intermediate the cable lock 10 and the amplifier (not shown). The cable 26 is also retained by the indentation or overhang of the ridge 30 above the channel. The amplifier plug 40 can now be plugged into the guitar's amplifier socket 42 and the guitar 34 is then ready for use. As a musician moves about a stage while playing the guitar 34, if the musician accidentally steps on the amplifier cable or if the amplifier cable gets caught on some object, then the plug 40 will not be pulled out of the socket 42 because the frictional grip of the cable lock 10 on the amplifier cable will prevent the amplifier cable from being pulled away from the socket 42. The guitar 34 shown in the illustrated example has a recessed amplifier socket 42. Because the cable lock 10 acts on the cable 26, the cable lock 10 is suitable for use with any type of guitar regardless of whether the guitar's amplifier socket is recessed or nonrecessed.

Figure 7:
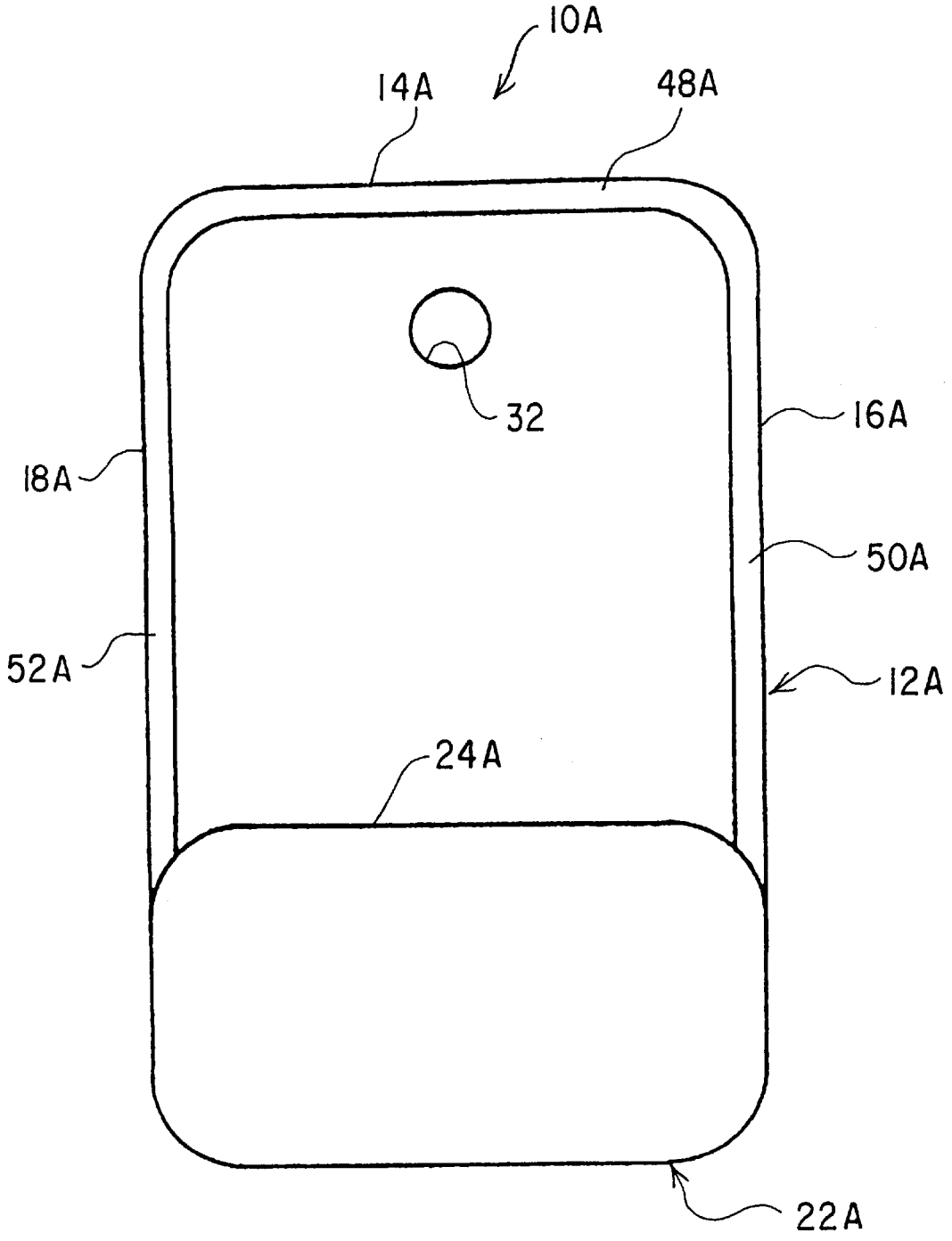
FIG. 7 is a front view of the second embodiment of the musical instrument cable lock according to the present invention.

Referring to FIGS. 6 and 7, a second embodiment 10A of the cable lock according to the present invention can be seen. Similar to the embodiment 10, the cable lock 10A includes a base portion 12A and a curved-back portion 22A which give the cable lock 10A a J-shaped profile. The most important difference between the lock 10A and lock 10 is that the beveled surface 28A extends through the entire thickness of the curved-back portion 22A such that the beveled surface 28A meets the outer surface 46 of the curved-back portion 22A at a distal terminal ridge 24A. The beveling operation which forms the beveled surface 28A can be applied to the entire periphery of the cable lock 10A, thus forming the beveled surfaces 48A, 50A, and 52A. The beveled surfaces 48A, 50A, and 52A further eliminate sharp edges that can damage the cable 26. The beveled surfaces 48A, 50A, and 52A extend through the entire thickness of the plate-like strip forming the cable lock 10A such that the flat surfaces 14, 16, and 18 are replaced with ridges 14A, 16A, and 18A.

Figure 8:
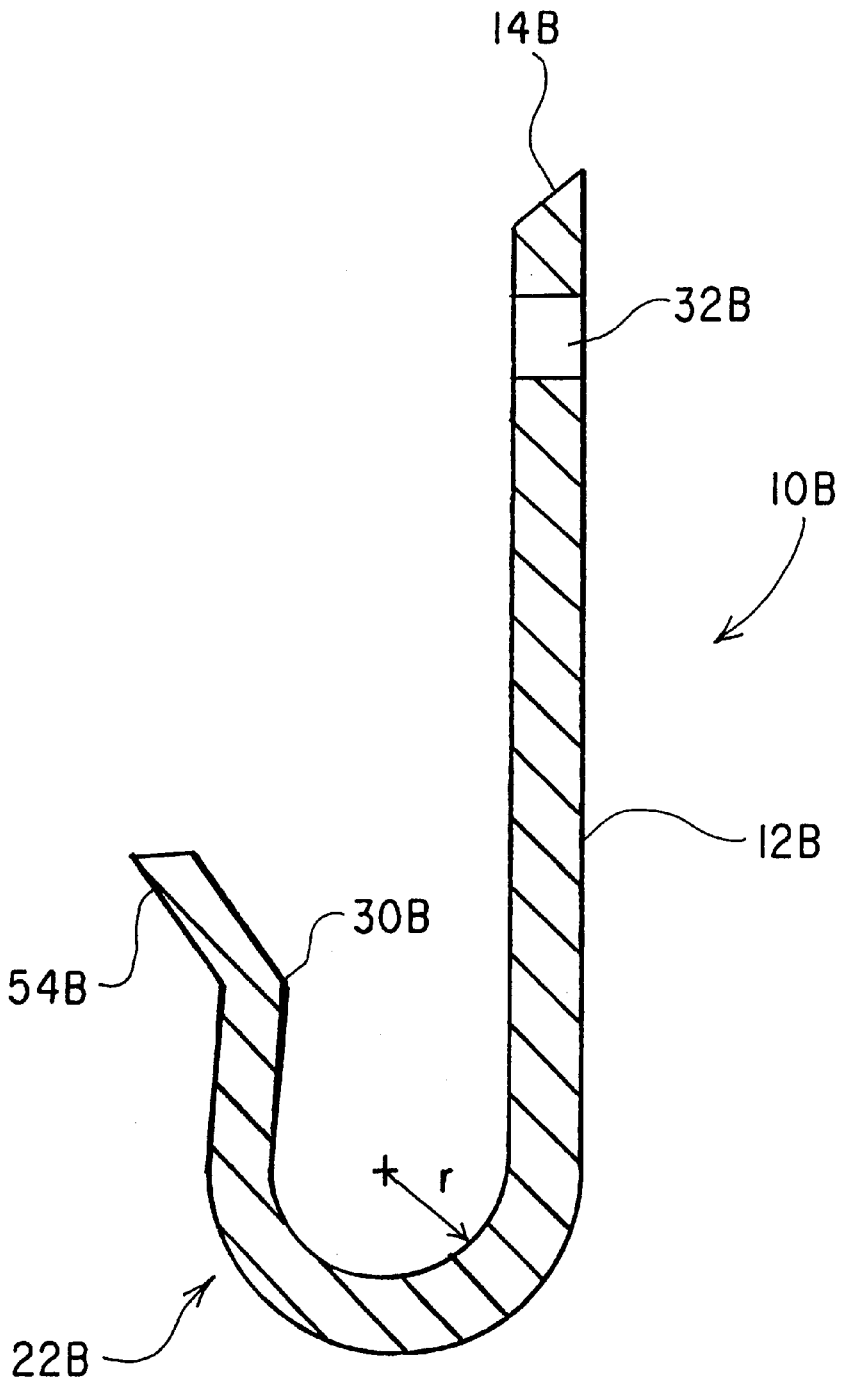
FIG. 8 is a longitudinal section view of a third embodiment of the musical instrument cable lock according to the present invention.

A third embodiment of the cable lock, designated generally as 10B, is shown in FIG. 8. The third embodiment includes a base portion 12B which is identical to the base portions 12 and 12A described above, and therefore will not be described further. In this embodiment, the curved-back portion 22B curved back towards the top side 14B to define a U-shaped channel with an inner radius of curvature r, but also includes a planar tab 54B which forms a dihedral angle with the ascending leg of the U-shaped channel and is angled away from the base 12B to form a ramp directing the cable 26 into the mouth of the U-shaped channel.

Figure 9:
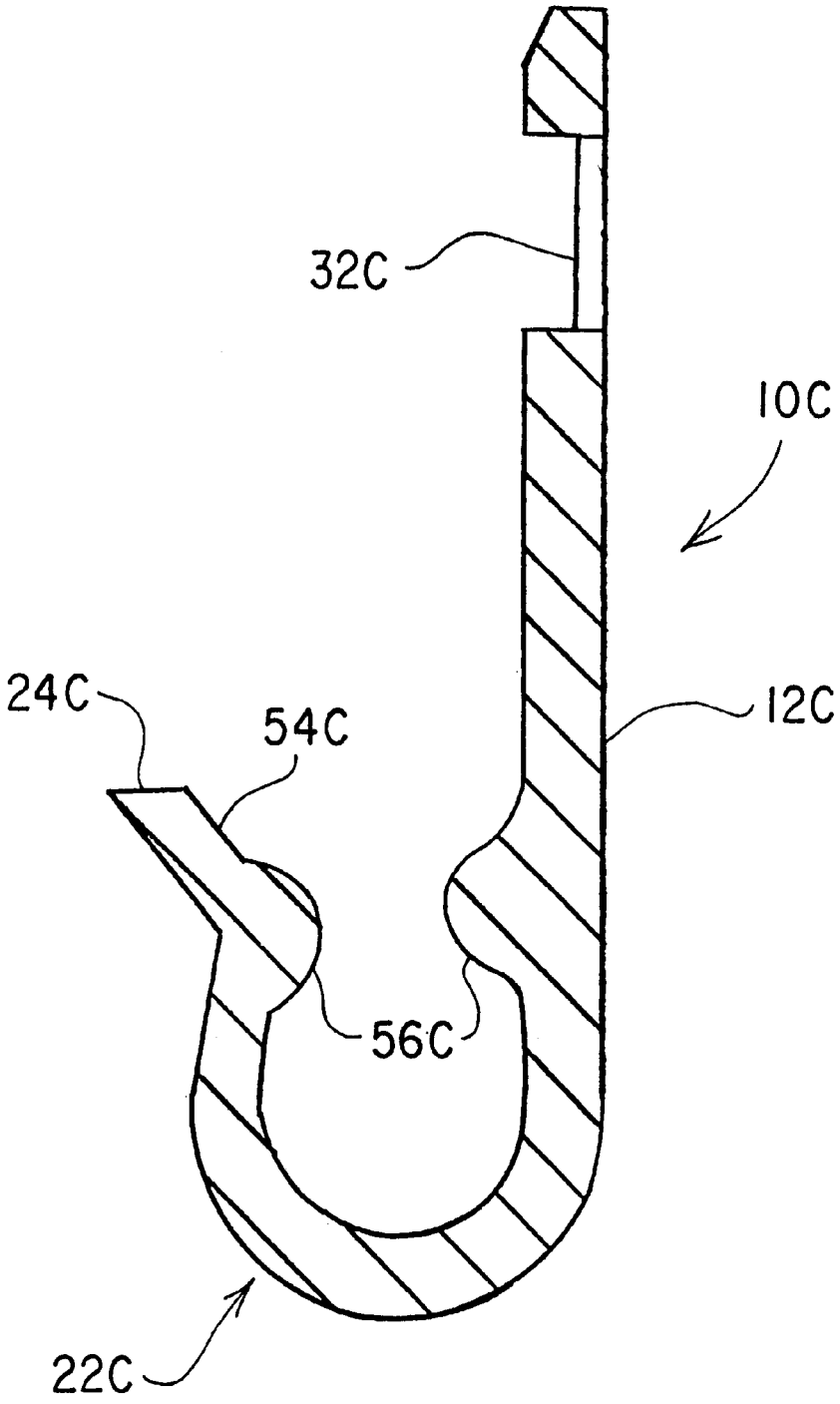
FIG. 9 is a longitudinal section view of a fourth embodiment of the musical instrument cable lock according to the present invention.
Figure 10:
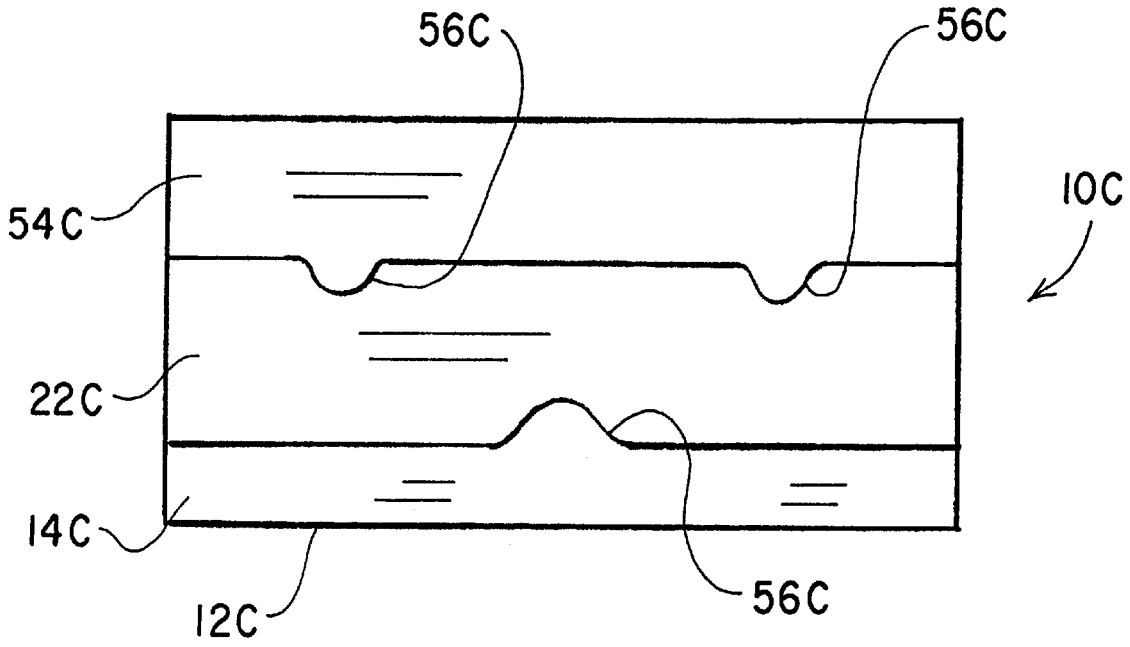
FIG. 10 is a top plan view of the fourth embodiment of the musical instrument cable lock according to the present invention.

A fourth embodiment of the cable lock, designated generally as 10C, is shown in FIGS. 9 and 10. As shown in the FIGS., this version of the cable lock 10C includes a base portion 12C which is substantially identical to the base portions 12, 12A and 12B, with the exception that the hole 32C is recessed into the front face of the base portion 12C. The advantage of this construction is that by recessing the hole 32C in the base portion 12C, a standard or stock screw 36 may be used to attach the cable lock 10C to the guitar, since the shaft of the screw 36 does not have to extend through the full thickness of the base portion 12C. A sufficient portion of the screw 36 (or nut) extends beyond the front face of the base portion 12C to permit the guitar sling to be snapped over the screw 36 and to be retained by the head of the screw 36.

FIGS. 9 and 10 also illustrate that the cable lock 10C may further comprise a knurled tab for retaining the cable in the channel formed by the base portion 12C and the curved back portion 22C. In the example shown, the curved-back portion 22C has an angled tab 54C substantially similar to the tab 54B described with respect to the third embodiment of the cable lock 10B. The "knurls" comprise one or more knobs 56C disposed at and projecting into the mouth of the U-shaped channel. FIGS. 9 and 10 illustrate that the knurls may comprise, e.g., a single knob 56C centrally located on the inner aspect of the base portion 12C and a pair of knobs 56C spaced apart a predetermined distance on the inner aspect of the tab 54C in opposition to the single knob 56C on the base portion 12C. The foregoing disposition of the knurls 56C is by way of illustration and not by way of limitation, as the scope of the present application is intended to extend to any variation of knurls used to retain the cable in the cable lock 10C, including a single knob 56C on the base portion 12C and none on the tab 54C, a single knob 56C on the tab 54C and none on the base portion 12C, or more than one knob 56C on either the base portion 12C or the tab 54C or both 12C and 54C. In use, the cable lock 10C and the cable 26 have sufficient flexibility between them to permit the cable 26 to be inserted past the knurls 56C in order to seat in the channel defined in the cable lock 10C, while knurls 56C provide sufficient resistance to prevent accidental removal of the cable 26 from the cable lock 10C.

It is to be understood that the present invention is not limited to the sole embodiment described above, but encompasses any and all embodiments within the scope of the following claims.

I claim:

1. A musical instrument cable lock comprising:

a plate-like strip extending from a top side to a distal terminal side, said plate-like strip having a substantially flat base portion and a curved-back portion extending between said base portion and said distal terminal side in order to define a J-shaped profile including a U-shaped channel, said curved-back portion having an inner radius of curvature dimensioned such that said curved-back portion can partially surround and frictionally grip a musical instrument cable.

2. The musical instrument cable lock according to claim 1, wherein said curved-back portion has a center of curvature and a beveled surface adjacent and contiguous with said distal terminal side, said beveled surface extending from said distal terminal side toward said center of curvature and terminating in a ridge.

3. The musical instrument cable lock according to claim 1, wherein said curved-back portion is slightly bent back towards said base portion so that the distance across the mouth of the U-shaped channel between said distal terminal side and said base portion is shorter than the distance across the base of the U-shaped channel, a portion of said distal terminal side overhanging said U-shaped channel so that the musical instrument cable is retained in the U-shaped channel both by friction and by said overhanging distal terminal side.

4. The musical instrument cable lock according to claim 1, wherein said base portion has a mounting hole proximate said top side.

5. The musical instrument cable lock according to claim 4, wherein the mounting hole is defined through a recess in said base portion.

6. The musical instrument cable lock according to claim 1, wherein said curved-back portion further includes a planar tab angled away from said base portion in order to form a ramp for sliding a musical instrument cable into the mouth of said U-shaped channel.

7. The musical instrument cable lock according to claim 1, further comprising at least one knurl projecting into the mouth of said U-shaped channel for retaining a musical instrument cable in said U-shaped channel.

8. The musical instrument cable lock according to claim 1, further comprising:

at least one knurl projecting from said base portion into the mouth of said U-shaped channel; and at least one knurl projecting from said curved-back portion into the mouth of said channel, the knurls on said base portion and said curved-back portion opposing each other in order to partially restrict that mouth of said U-shaped channel and retain a musical instrument cable in said U-shaped channel.

9. The musical instrument cable lock according to claim 1, wherein said cable lock is made from metal and made in one piece.

10. The musical instrument cable lock according to claim 1, wherein said cable lock is made from plastic and made in one piece.

11. A musical instrument cable lock for attachment to a musical instrument for relieving strain on a cable connector, the cable lock comprising a semi-rigid, one-piece, J-shaped body having:

a) a substantially flat, planar, rectangular base portion having a hole defined therein sized and dimensioned for receiving a screw in order to attach the cable lock to a musical instrument, the base portion further having a top side, first and second lateral sides, and a bottom boundary; and b) a curved-back portion extending from the bottom boundary of said base portion and curving back to extend toward the top side of said base portion, defining a U-shaped channel having a mouth, a base, and an upright leg opposed to said base portion, said U-shaped channel having a radius of curvature sized and dimensioned for snugly receiving a musical instrument cable in said U-shaped channel.

12. The musical instrument cable lock according to claim 11, wherein said base portion has a recess defined therein, the hole being defined in the recess.

13. The musical instrument cable lock according to claim 11, wherein the upright leg of said curved-back portion is slightly bent back towards said base portion so that the mouth of said U-shaped channel is narrower than the base of said U-shaped channel.

14. The musical instrument cable lock according to claim 11, wherein the upright leg of said curved-back portion terminates in a distal terminal side, the distal terminal side being beveled and sloping downward and inward towards said U-shaped channel.

15. The musical instrument cable lock according to claim 14, wherein the top side and the first and second lateral sides of said base portion are beveled.

16. The musical instrument cable lock according to claim 11, wherein said curved-back portion further includes a planar tab forming a dihedral angle with the upright leg, the tab being angled away from said base portion and defining a ramp leading to the mouth of said U-shaped channel.

17. The musical instrument cable lock according to claim 11, further comprising at least one knurl projecting into the mouth of said U-shaped channel for retaining a musical instrument cable in said U-shaped channel.

18. The musical instrument cable lock according to claim 11, further comprising:

a) at least one knurl projecting from said base portion into the mouth of said U-shaped channel; and b) at least one knurl projecting from said curved-back portion into the mouth of said channel, the knurls on said base portion and said curved-back portion opposing each other in order to partially restrict that mouth of said U-shaped channel and retain a musical instrument cable in said U-shaped channel.

19. The musical instrument cable lock according to claim 11, wherein said cable lock is made from plastic.

* * * * *